United States Patent [19]

Schultz

[11] 4,039,112

[45] Aug. 2, 1977

[54] APPARATUS FOR AUTOMATICALLY CONSTRUCTING FRAME STRUCTURES

[76] Inventor: Bethel F. Schultz, Rte. 1, Box 47-D, Harrisburg, Oreg. 97446

[21] Appl. No.: 691,711

[22] Filed: June 1, 1976

[51] Int. Cl.[2] ..... B27F 7/02

[52] U.S. Cl. ..... 227/40; 227/48; 227/100

[58] Field of Search ..... 29/407, 430; 227/14, 227/27, 40, 48, 50, 99, 100, 152

[56] References Cited

U.S. PATENT DOCUMENTS

| | | | |
|---|---|---|---|
| 3,086,210 | 4/1963 | Good et al. | 227/99 |
| 3,628,714 | 12/1971 | Offenwanger | 227/100 |
| 3,822,815 | 7/1974 | Davis | 227/40 |
| 3,848,791 | 11/1974 | Jureit et al. | 227/100 |
| 3,873,015 | 3/1975 | Whitaker | 227/100 |

*Primary Examiner*—Granville Y. Custer, Jr.
*Attorney, Agent, or Firm*—Chernoff & Vilhauer

[57] ABSTRACT

Apparatus for automatically constructing prefabricated building stud walls or other frame structures from standard raw materials. Elongate studs are placed transversely at spaced intervals between a pair of elongate wall plates by a reciprocating stud selector and drive mechanism. As each stud is placed between the plates it is automatically nailed thereto, forming a portion of the frame, after which the completed portion of the frame is advanced an incremental distance along an assembly structure by the drive mechanism, which pushes on the newly nailed stud to advance the frame to a position for nailing the next succeeding stud, and so forth in automatic cyclic fashion. Glue may be applied to the completed portion of the frame and, as soon as a large enough portion is completed, sheathing material may be placed thereon and fastened thereto by the glue and/or mechanical nailers. In the interim, holes for receiving electrical and plumbing conduit are drilled in the studs. After the sheating material has been attached a saw cuts any necessary apertures for doors, windows and the like, thereby completing the prefabricated wall. The apparatus includes, besides the aforementioned stud selector and drive mechanism, an extension feature for semi-automatically varying the spacing between selected studs for window and door openings, and an override feature for placing multiple studs immediately adjacent one another for added strength at predetermined locations.

10 Claims, 6 Drawing Figures

APPARATUS FOR AUTOMATICALLY CONSTRUCTING FRAME STRUCTURES

BACKGROUND OF THE INVENTION

The present invention relates to an automatic apparatus for constructing frame structures from standard raw materials, and particularly to apparatus for constructing building stud walls.

In the building construction industry the construction of building stud walls, that is, the "framing" of a building, is typically a highly labor intensive activity and is thus very expensive. Such walls are conventionally made by assembling a plurality of elongate wooden studs vertically in parallel relation to one another at predetermined intervals longitudinally between and perpendicular to a pair of elongate horizontally-disposed wooden plate members, and nailing the studs to the plates. The frame thus assembled and nailed together, if for an outside wall, is the then covered on at least one side by sheathing, usually plywood sheets which are nailed to the frame. Ordinarily, the apertures for doors, windows and the like are formed by precutting the parts of the wall prior to assembly, and holes for the electrical and plumbing conduit are drilled by the appropriate subcontractor after the entire building frame is constructed and sheathed. All of these steps ordinarily require the efforts of a number of individual laborers at the building site and are performed at different times. However, it has been found that the expense of framing can be considerably reduced by applying mass production techniques to produce prefabricated walls which may be erected at the building site in partially finished form, and that the cost can be further reduced and the quality increased by use of automatic machinery to produce the walls.

Several apparatus have previously been invented which attempt to accomplish effectively the result of automatically, or semi-automatically, manufacturing prefabricated wall frames. For example, Hurn et al. U.S. Pat. No. 3,564,702 discloses a type of apparatus for assembling part of a wall frame, but is quite complex and does not show any specific mechanism for feeding those parts to the assembly apparatus or for completing the wall by adding sheathing and cutting holes for windows, doors or conduit. Kellner et al U.S. Pat. No. 3,851,384 also shows an apparatus for manufacturing a prefabricated building wall, but is even more complex, requiring a very complicated mechanicam for assembling the parts of the wall. Similarly, Bamford, Sr., U.S. Pat. No. 2,574,163 discloses an apparatus for assembling a building wall, but it utilizes complex moving mechanism for distributing the parts of a wall over an assembly table and requires that some of those parts be individually prefabricated. Jureit et al. U.S. Pat. No. 3,685,129 and Carroll U.S. Pat. No. 3,399,445 also disclose apparatus of this generally type.

Despite the aforementioned inventions disclosed in previous patents for constructing building walls, there remains a need for an improved and more efficient apparatus for constructing such walls which minimizes human labor, produces with a high degree of accuracy and speed a prefabricated sheathed wall having apertures for doors, windows and the like formed therein, and is uncomplicated yet flexible in its application.

SUMMARY OF THE INVENTION

The present invention satisfies the aforementioned need for a more effective and efficient apparatus for automatically constructing such building walls by providing a unique sequence of assembly steps which may be implemented by a novel, accurate, uncomplicated and versatile assembly apparatus.

In the present invention, raw wall frame studs precut to a standard length are automatically fed serially from a stack into spaced positions transversely between a pair of parallel wall frame plates. As each stud is placed between the plates, it is automatically nailed thereto and the completed portion of the wall is immediately subjected to further processing to expedite construction. Next, glue is automatically applied to the edges of the completed portion of the wall frame and, when a sufficient area of the wall frame has been completed sheathing material is placed in proper position and nailed to the glued edges of the frame. Holes are also cut in the wall after application of the sheathing at predetermined locations to accommodate doors and windows thereby eliminating the need to precut the wall parts, particularly the studs and sheathing, to odd dimensions prior to assembly. Holes for receiving plumbing and electrical conduit are automatically drilled in the studs at predetermined locations, thereby greatly reducing the time required by the individual electrical and plumging subcontractors.

The novel apparatus for implementing the aforementioned utilizes a unique reciprocating mechanism which serially removes the wall frame studs from a stack, places each stud in transverse position between the wall frame plates, all of which are horizontally-disposed, and after each stud has been automatically nailed to the plates moves the completed portion of the frame down an assembly support structure a predetermined incremental distance for further processing. After each incremental advancement of the frame, a further stud is positioned and nailed and the cycle is automically repeated.

The principal elements of the reciprocating mechanism are a reciprocating carriage with upright fingers for engaging the nailed studs, which eliminates the need for a complicated continuous-conveyor type drive, and a stud selector member connector to the carriage for removing each stud from a stack. A particular feature of the reciprocating mechanism enables an operator to produce multiple studding, that is, to place two or more studs side-by-side immediately adjacent to one another for additional strength, for example where window or door apertures are to be built, in semi-automatic fashion. Aother feature permits the spacing of the wall frame studs to be varied from a predetermined, automatically-provided spacing as required for doors and windows.

Automatic glue applicators are provided in the apparatus for applying glue to finished portions of the wall frame and a mechanism is provided for dispensing sheathing from a stack of standard sheet material into positions on the wall frame for gluing thereto. Automatic nailers are also provided for securely attaching the sheathing material to the wall frame after it has been placed in position.

A saw, capable of being moved into a variety of positions, is provided for cutting apertures of predetermined size and shape in the wall after the studs have been nailed and after sheathing material has been attached to the frame.

This sequence of mechanisms and steps enables pieces of standard size raw wall materials, i.e. studs and sheathing, to be placed in stacks for use in assembling the frame, without having to be individually precut to different sizes for different specific purposes and placed in a predetermined order in the stacks of material for assembly. The resultant system greatly speeds the process of frame construction resulting in much lower labor cost and rendering the overall assembly process extremely economic.

A projector and screen may also be provided to operate in synchronism with the reciprocating mechanism such that a plan drawing of the portion of the wall frame being constructed at any given moment in the initial stage of the apparatus is visually displayed on the screen for viewing by an operator. As a result, the operator may determine from the plan corresponding to the very wall being constructed at that moment whether any special provision, such as multiple studding or a different stud spacing, is to be provided and thus can operate the machine semi-automtically to produce that plan feature.

It is therefore a principal objective of the present invention to provide a novel and improved apparatus for rapidly, economically and accurately constructing prefabricated frame structures such as building walls utilizing a minimum of human labor.

It is another objective of the present invention to provide such a construction apparatus capable of constructing prefabricated sheathed building stud walls having apertures for doors and windows.

It is a further objective of the present invention to provide such an apparatus whereby supplies of standard size raw wall frame materials may be utilized as input material with a minimum of individual part prefabrication, and wherein the complexity of the construction mechanism is minimized while the versatility necessary to construct particular features in a given wall is provided.

The foregoing objectives, features and advantages of the present invention will be more readily understood upon consideration of the following detailed description of the invention taken in conjunction with the accompanying drawings.

DETAILED DESCRIPTION OF THE INVENTION

Figure 1:
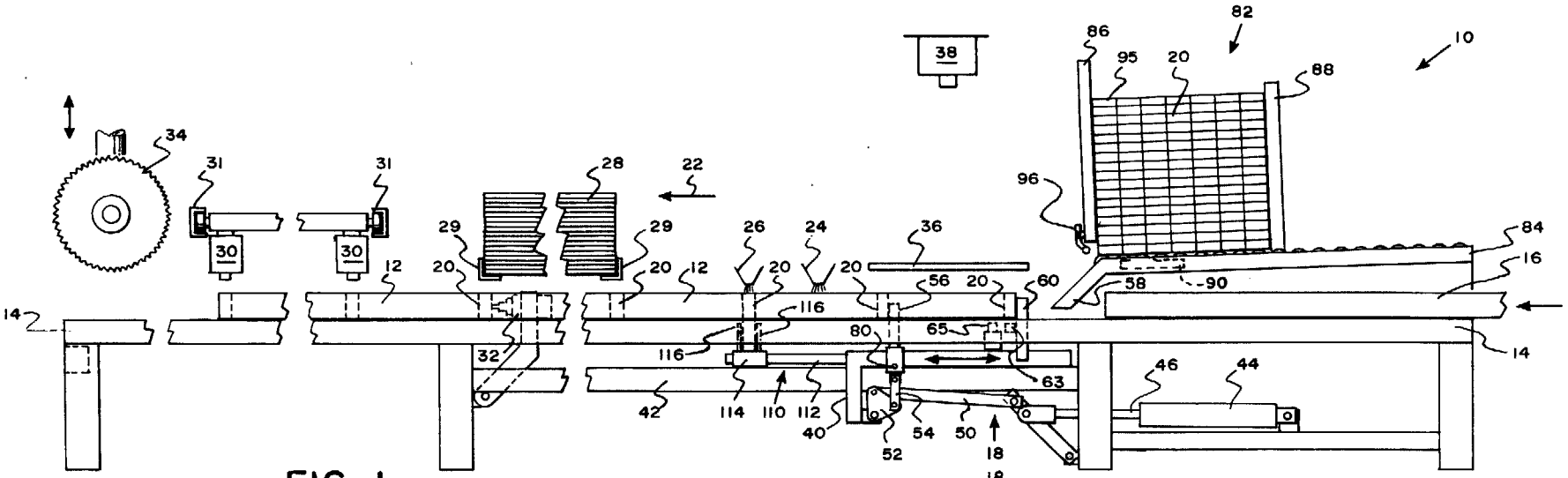
FIG. 1 is a simplified side elevation of a frame assembly apparatus embodying the present invention.
Figure 2:
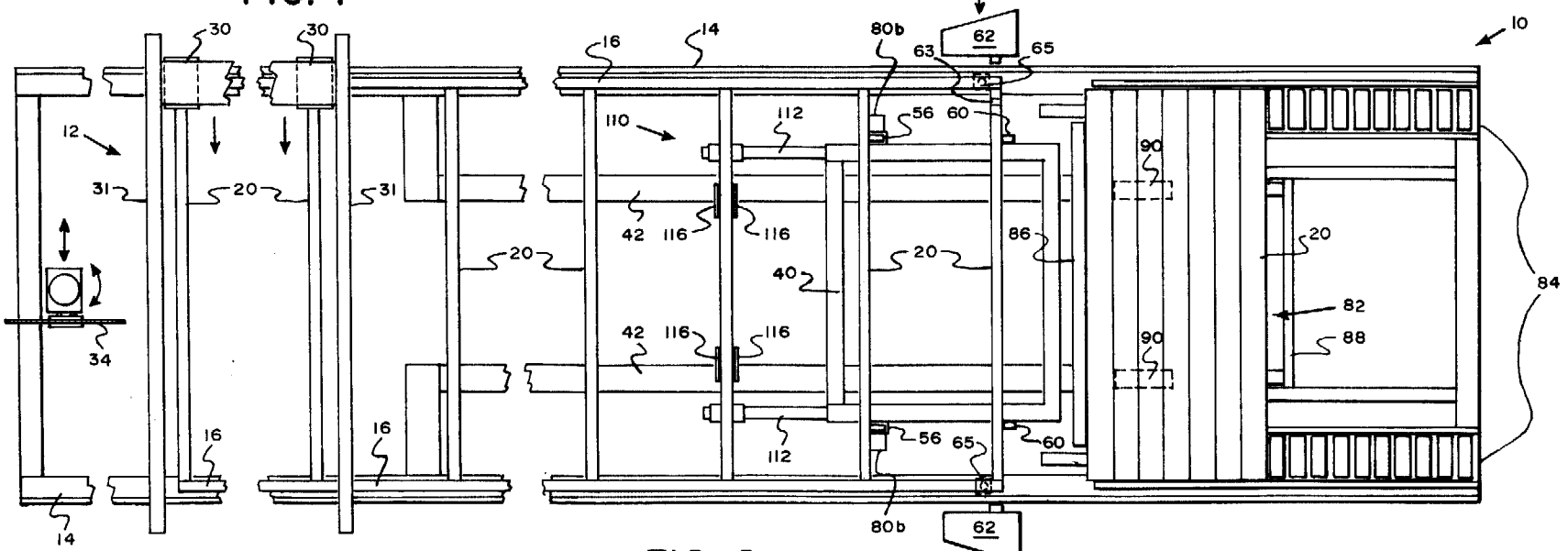
FIG. 2 is a simplified top view of the apparatus of FIG 1, with some portions thereof removed for clarity.

Referring first to FIGS. 1 and 2, the present invention is shown embodied in an automatic frame assembly apparatus 10 which assembles raw boards of standard dimensions into a building wall frame 12, applies sheathing material to the frame, drills holes in the frame for electrical wiring and plumbing, and cuts holes in the wall for apertures such as doors, windows and the like. In the aforedescribed apparatus, construction of the wall takes place by assembling the raw materials and fastening them together in a horizontal position on an elongate support 14. The wall frame plates 16, that is, the top and bottom horizontal pieces of the wall frame, are fed onto the support longitudinally at opposite sides thereof until their ends reach a fastening station 18 where a standard size frame stud 20 is placed to extend transversely between and perpendicular to the plates, and nailed thereto by automatic nailing guns 62 (FIG. 2), preferably two of which are located one above the other on each side of the support 14 so as to drive a pair of nails through each plate and into the ends of the stud. Thereafter, the plates and nailed stud are moved forwardly in the direction shown by arrow 22 along the support 14 a predetermined distance corresponding to the desired stud spacing of the wall frame, and another stud is placed between the plates and nailed thereto at the fastening station 18. This process is repeated until a complete frame has been assembled and nailed together. For framing doors and windows, additional studs are nailed between the regularly spaced studs as required in the manner to be described hereafter.

While the frame is being assembled and nailed together, and after a completed portion passes the fastening station 18, glue is applied to the upper edges of the plates of the completed portion by a glue applicator 24 and to the upper edges of the regularly spaced studs by a transversely moving glue applicator 26. Thereafter, pieces of standard size sheathing material 28 from a stack are laid individually by a sheathing dispenser 29 upon the top of the frame in edge-to-edge abutment as it moves forwardly down the support 14 and are nailed to the plates and regularly spaced studs respectively by multiple (preferably four, although only two are shown) automatic overhead nailers or staplers 30 which are arranged abreast longitudinally of the support 14 and are drivingly mounted on transverse tracks 31 so as to align with the studs and advance across the studs transversely to the length of the support 14.

One or more automatic drills such as 32 are included in the apparatus to drill holes in the studs for receiving electrical wiring and plumbing conduit, actuation of the drill being synchronized with the movement of the frame along the horizontal support 14. In addition, a saw 34, adapted for movement into a variety of positions, is provided for cutting holes in the wall after the sheathing has been attached for placement of windows, doors, and other openings.

If it is desired to construct a double-sheathed or prestressed wall section, the section may be inverted after the first sheathing has been applied, thermal insulation may be placed between the studs, and sheathing on the opposite side may be affixed by glue and nailers in the same general manner previously described.

Some of the operations of the framing apparatus 10 are under the control of a human operator, as explained hereafter, and in order for the operator to compare the wall which is being constructed to the plans with which it is to comply, a screen 36 may be provided above the fastening station 18 with an overhead projector 38 displaying an image of the wall plan on the screen as the wall is constructed. The projector should be designed such that the image of the wall plan moves on the screen in synchronism with the wall frame itself so that there is a one-to-one correspondence between the portion of the wall being constructed and the portion of the plan which is being followed at any given moment.

Figure 3:
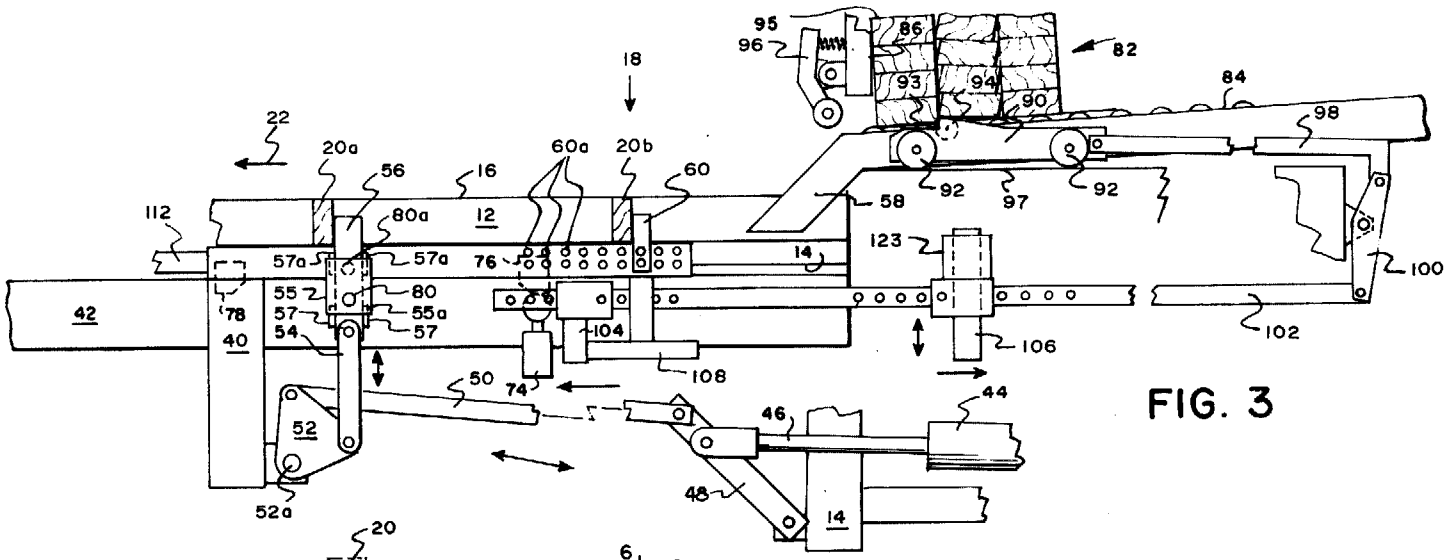
FIG. 3 is a side, detail view of drive and stud selection mechanisms utilized in the apparatus of FIG. 1.
Figure 5:
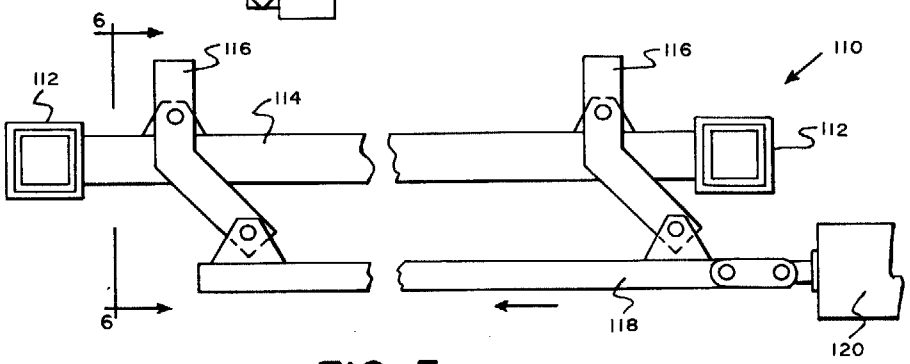
FIG. 5 is a front view of a carriage extension mechanism used in the assembly apparatus.
Figure 6:
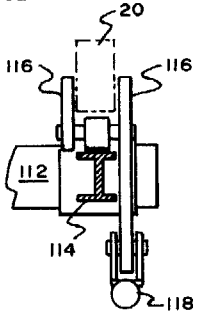
FIG. 6 is a sectional view of the carriage extension mechanism taken along line 6—6 of FIG. 5.

Turning now to FIG. 3 as well as FIGS. 1 and 2, the drive mechanism of the framing apparatus 10 comprises a carriage 40 disposed primarily beneath the upper work surface of the support 14 and slideably mounted atop tracks 42 which permit the carriage to slide back and forth cyclicly along the elongate dimension of the support 14. The carriage is reciprocated by a hydraulic cylinder 44 which alternately pushes and pulls on the carriage 40 through a mechanical linkage. It is recognized, however, that other reciprocating motors and linkages might also be utilized in place of a hydraulic cylinder without departing from the principles of this invention.

The piston rod 46 of the hydraulic cylinder 44 is connected to the carriage 40 through a lever arm 48 pivotally attached to the support 14, a drive push rod 50 and a bell crank 52 pivotally mounted on the carriage. The bell crank is connected through a finger push rod 54 to a vertically-oriented, movable finger 56 slidably mounted in a sleeve 55 on the carriage to move up and down between a lower position where the top of the finger 56 is below the bottom edges of the studs, and an upper position as shown in FIG. 3 where the top of the finger is above the bottom edges of the studs. Accordingly, when the piston rod 46 starts to extend forwardly, it first rotates the bell crank 52 in a counterclockwise direction which, in turn drives the slidable finger 56 upward until a stop 57 abuts a bottom flange 55a of the sleeve 55. At that point the crank 52 can no longer rotate, and further extension of the piston rod forces the carriage forward on its track 42. Conversely, when the piston rod 46 begins to retract, it rotates the bell crank 52 clockwise, which lowers the finger 56 until a stop 57*a* abuts the flange 55*a*. At this point the bell crank can no longer rotate clockwise and further retraction of the piston rod pulls the carriage backwards in the opposite direction. In this manner reciprocal motion of the hydraulic cylinder rod produces reciprocal motion of the carriage while simultaneously raising the movable finger 56 during forward motion and lowering it during rearward motion for reasons to be described hereafter. As seen in FIG. 2, there are two such movable fingers 56 transversely spaced and connected to one another through a pair of bell cranks such as 52 mounted on a common bellcrank shaft 52*a* so as to move in unison.

As shown in FIG. 3, the carriage 40 is in its foremost position with the piston rod 46 at the end of its pushing stroke and the raised fingers 56 abutting the rear side of a nailed stud 20*a* by which they have pushed the frame 12 forward. The next succeeding stud 20*b* has just been nailed at the fastening station 18 by automatic nailers 62. When the carriage is drawn back to its rearmost position, the fingers 56 are lowered and assume a position rearward of the stud 20*b*, while a further stud is simultaneously caused to drop down onto the support 14 from a ramp 58, in a manner to be explained below, to a position rearward of the fingers 56. At this time second a pair of transversely spaced upright fingers 60, fixedly attached to the rear of the carriage 40 at adjustable positions determined by apertures 60*a*, are positioned rearward of this further stud. When the carriage is thereafter caused to move forward, the fingers 56 are raised and push the frame forward by their engagement with the rear side of the nailed stud 20*b*. The fixed fingers then engage the further stud and push it forward to the fastening station 18 when the carriage 40 reaches its foremost position. At that point the plates 16 are nailed to the ends of the further stud by automatic nailers 62, located at the fastening station 18 at a position outside the wall frame plates 16, which drive nails through the plates and into the ends of the stud. A limit switch 63 mounted beneath the support 14 and having an actuator extending upwardly into the path of the studs at the fastening station 18 senses the presence of each stud when in proper position and actuates the nailers 62. Once the plates are nailed to the stud the carriage is then pulled rearwardly and the movable fingers 56 are automatically retracted to a down position, as described above, so that they will move behind the freshly nailed stud without interference. The cycle is repeated such that the carriage continually moves the wall frame 12 forwardly in increments equal to the desired predetermined stud spacing. For a different predetermined regular and stud spacing, the stroke of the piston rod 46 is varied as described hereafter, and the position of the fixed fingers 60 is adjusted to the proper set of apertures 60*a* such that the distance between the front of the fingers 60 and the front of the fingers 56 equals the desired stud spacing, and such that the fixed fingers 60 arrive at the fastening station 18 at the foremost position of the carriage 40. For reasons to be described hereafter, the movable fingers 56 may be selectively locked in their down positions by, either manually or automatically, placing a pin through hole 80 of the sleeve 55 and into a mating hole 80*a* (FIG. 3) in the side of the finger. Automatic insertion of the pin can be accomplished by any suitable mechanism, for example an electric solenoid 80*b* depicted schematically in FIG. 2 actuated remotely by the operator. With the slidable fingers 56 locked down the bell crank 52 will no longer rotate, but the carriage will continue to reciprocate under the power of the hydraulic cylinder 44. Because the fingers 56 are locked down, they will not push the frame forward as the carriage moves forward. This feature has significance for achieving irregular stud spacing, discussed in detail later.

When the end of the plates 16 is reached during the above described sequence, it is necessary either manually or mechanically to place the forward ends of two fresh plates on the support 14 at the fastening station 18 such that a stud can be nailed thereto. To facilitate the placement of the fresh plates, a pair of solenoid-actuated pins 65 are pushed upwardly from their normal positions beneath the support 14 to a position immediately in front of the fastening station 18 so that the forward ends of the fresh plates may be abutted against the pins 65 to insure proper placement. Thereafter the machine can simply be allowed to repeat the cycle previously described.

Figure 4:
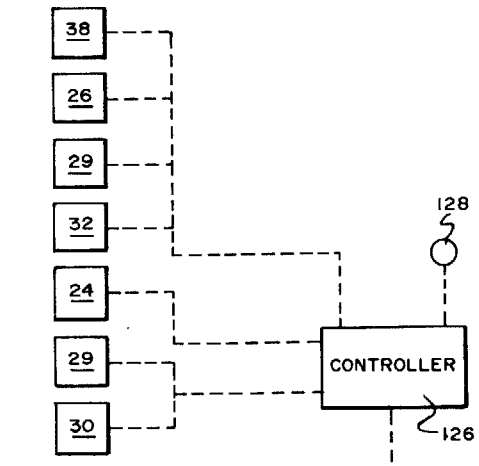
FIG. 4 is a schematic diagram of a control system for operating the drive mechanism shown in FIG. 3 and other automatic mechanisms used in the assembly apparatus.
Figure 4:
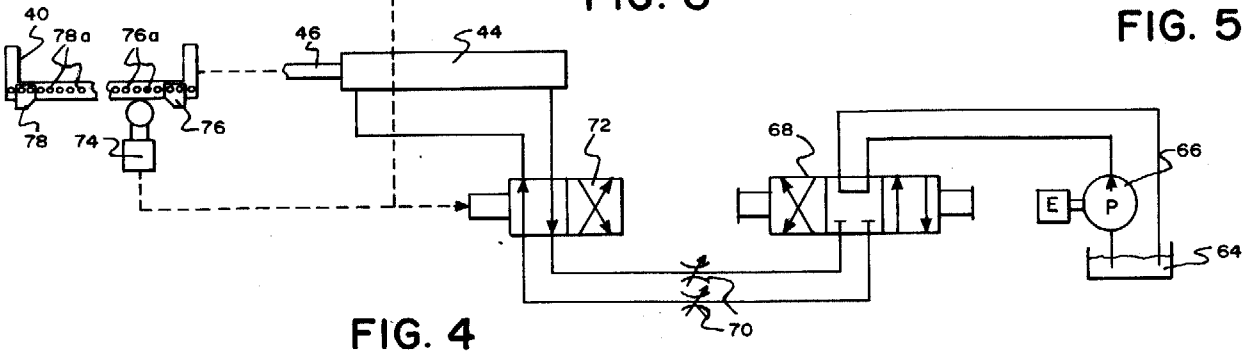

Referring now primarily to FIGS. 1, 3 and 4 the carriage drive mechanism of the preferred embodiment utilizes an electromechanically controlled hydraulic system for producing automatic reciprocating motion. The hydraulic system comprises a fluid reservoir 64, an electrically powered hydraulic pump 66, a manually operated three-way valve 68 for selectively activating or deactivating the cylinder 44 and controlling the direction of movement of the piston rod 46, a pair of flow control valves 70 for controlling the speed of the piston rod, and a solenoid-operated reversing valve 72 for automatically controlling the direction of movement of the piston rod 46. The solenoid valve 72 is electrically powered and is controlled by a two-position limit switch 74. The carriage 40 has a pair of cams 76 and 78 adjustably attached thereto by bolts inserted through appropriate sets of apertures 76*a* and 78*a* respectively for operating the limit switch 74 which is positioned between the two cams.

With the manual valve 68 placed in a position permitting fluid to flow to the hydraulic cylinder 44, and the solenoid valve 72 in the appropriate position, the carriage 40 will move forwardly as described above. The distance that the carriage moves forwardly depends upon the position of the cam 76, since when the cam 76 strikes the limit switch 74 is reverses the solenoid valve 72 thereby causing the hydraulic cylinder automatically to pull rearward on the carriage. Similarly, when the cam 78 strikes the limit switch during rearward movement of the carriage, the valve 72 is again reversed and the hydraulic cylinder begins to push forward again on the carriage. In this manner automatic reciprocal motion of the carriage is produced as long as the valve 68 is actuated. The speed of movement of the carriage may be adjusted to a predetermined level by the flow control valves 70, and the direction of movement of the carriage and its speed may be manually varied at any given moment by reversal and throttling respectively of the manual valve 68. Length of piston stroke and location of reversal points is determined by the adjustable locations of the cams 76 and 78, comprising one factor in varying the stud spacing as described above. It is recognized that while the aforedescribed control system is particularly suitable for use in the preferred embodiment of the present invention, other control systems might also be utilized to a lesser advantage without departing from the principles of this invention. Regardless of the type of mechanism used however, or the variation of stud spacing, the position of the fixed finger 60 of the carriage 40 must be coordinated with the movement of the carriage, as determined by the stroke of the piston rod 46 or other mover, such that the finger 60 positions a stud at the fastening station 18 at the foremost position of the carriage.

The studs 20 are placed transversely in a stack 82 on a forwardly sloped conveyor 84 (FIG. 1) above the support 14 such that they tend to move under the force of gravity toward the front of the support, but are held back by a forward wall 86. While the conveyor is shown to be of the roller type, any suitable passive, or active conveyor might be used. A movable rear retainer 88 is also provided to keep the studs in a stacked formation. A pair of transversely spaced stud selectors 90, one of which is shown in FIG. 3, movably mounted by a plurality of rollers 92 on a horizontal track 97 for reciprocal forward and rearward motion in unison immediately beneath the stack of studs 82, push each new stud out of the stack and down the ramp 58 automatically at the appropriate time. Each stud selector 90 has an upwardly projecting dog 93, the forward and downward slope of the conveyor 84 relative to the horizontal track 97 being such that the dog engages the rear edge of the bottom stud in the foremost column 95 (FIG. 1) of the stack of studs 82 on each forward motion, without engaging the rear edge of the bottom stud in the preceding column, thereby forcing the engaged stud out from beneath the stack. Inadvertent engagement of the rear edge of the bottom stud in the preceding column is prevented in all cases because the downward and forward slope of the conveyor 84 relative to the horizontal track 97 supports the rear edge of the bottom stud in the preceding column at too high an elevation relative to the upwardly projecting dogs 93 for such engagement. Only the rear edge of the stud in the foremost column 95 is low enough, due to the downward slope of the conveyor 84, to be engaged by the dogs 93. The stud slides transversely down the ramp 58 and lands on edge on the support 14 preparatory to being engaged on the succeeding forward movement of the carriage 40 by the fixed fingers 60. Damage to the bottom surfaces of the studs from the reciprocal movement of the stud selector 90 beneath them is prevented by the cammed sloped shape of the rear edge of the dog 93 and the provision of a roller 94 atop the stud selector. The bottom stud of the foremost column 95 of the stack 82 is held in place by a spring-loaded retainer 96 until the force of the stud selector pushing on the newly selected stud deflects the retainer. The retainer 96 is particularly important to keep the final stud in the column 95 from dropping down the ramp prematurely, since there is no frictional engagement of studs above the final stud to help retain it until the stud selector pushes it forward.

Reciprocal motion of the stud selectors 90 is produced in automatic synchronization with the movement of the carriage 40 by connection of the stud selector through a mechanical linkage to the carriage. Each stud selector is connected by a push rod 98 to a lever 100 which is driven by a stud selector actuation arm 102. The actuation arm contains a depending front stop 104 and a depending rear stop 106, which are normally engaged by a foot 108 attached to the carriage 40. The rear stop 106 is selectively liftable by a solenoid 123 to a position where the foot 108 cannot engage it, for reasons to be explained hereafter. When the carriage approaches its extreme forward position, as shown in FIG. 3, the foot 108 engages the forward stop 104 which causes the actuation rod 102 to be pulled forward and each stud selector 90 to be pulled rearwardly to a retracted position with the front of the dog 93 behind the rear edge of foremost stud column 95. As the carriage begins to move rearwardly its foot 108 disengages the forward stop and the carriage moves almost entirely to its rearmost position before engaging the rear stop 106, whereupon the actuation arm 102 is pushed rearwardly and each stud selector 90 is pushed forwardly, thereby forcing a new stud down the ramp 58. By adjusting the positions of the forward and rear stops 104 and 106, the stud selectors may be adjusted for accommodating varying width studs, and by adjusting the forward stop 104 the movement of the stud selectors may be synchronized for varying stud spacing.

According to the method of the present invention, a stud is always nailed at each interval corresponding to the predetermined stud spacing dictated by the settings of the carriage cams 76 and 78 and the fixed finger 60. This enables the use of standard size sheathing material and insures that a stud is always located beneath the transversely movable stud glue applicator 26 and sheathing nailers 30. However there are some instances in which it is desirable to add further studs between the regularly spaced studs for the framing of doors and windows. In such cases it is necessary to achieve a stud spacing less than that for which the machine is set. To permit such irregular adjustments of stud spacing the preferred embodiment of the invention includes an extension member 110, as shown in FIGS. 1, 2, 5 and 6, for selectively grasping a stud which has previously been nailed to the plates and, by manual control of the valve 68, moving the wall frame forwardly or rearwardly an irregular distance. Preferably the extension member comprises a pair of elongate rods 112 longitudinally adjustably mounted on the carriage 40, and a cross member 114 attached across the two rods toward the front thereof, the cross member 114 ordinarily being positioned a distance from the front of the movable fingers 56 on the carriage equal to the predetermined stud spacing. Two pairs of retractable finger members 116, pivotally attached to either side of the cross member 114, may be pivoted upright to bracket a stud which has already been nailed to the plates so that the wall frame may be grasped and pushed forwardly or rearwardly by the motion of the carriage, or pivoted down so that they will move freely beneath the studs without interference. Pivoting of the fingers 116 is accomplished by a push rod 118 attached thereto and a solenoid 120 which selectively drives the push rod when actuated by a remote manual control.

To utilize the extension member 110, for example to provide a fraction of the regular stud spacing, the automatic carriage operation is interrupted after the nailing of the preceding stud by manipulation of valve 68. Simultaneously the movable fingers 56 are locked down. Thereafter the carriage is retracted to its rearmost position by manual operation of valve 68 and the fingers 116 are raised to grasp a nailed stud, after which the carriage is moved forward by manipulation of valve 68 to provide the desired fractional spacing between the last nailed stud and the fastening station 18. Then the retractable fingers 116 are pivoted down and the carriage is permitted to move to its foremost position to place the new stud at the fastening station 18. The new stud is nailed and the foregoing procedure is repeated to properly position and nail the next regularly spaced stud. Thereafter the movable fingers 56 are unlocked and construction of the frame proceeds automatically in the usual fashion.

In some instances, for example, where a door or window is to be placed in a wall, it is desirable to place two or more studs side-by-side in abutment for additional strength on either side of the opening. To accomplish this result, the first stud of the multiple is nailed in the desired position. Thereafter the fingers 56 are locked down so that they will not push the frame forward on the next forward movement of the carriage. Instead, when a new stud drops down the ramp 58, the fixed finger 60 will bring it into abutment behind the previously nailed stud at the fastening station, thereby pushing the wall forward a distance equal to the width of the stud. The second stud is nailed, and the procedure may be repeated again if called for. Thereafter the next regularly spaced stud is positioned and nailed, the fingers 56 are unlocked, and construction in the fully automatic fashion is resumed.

If it is desired to avoid the dispensing of a stud from the stack 82 upon any particular retraction of the carriage 40, for example to obtain a greater than regular spacing, the solenoid 123 (FIG. 3) is actuated to lift the rear stud selector prop 106 so as to prevent the forward motion of the stud selectors 90. This will also prevent subsequent actuation of the nailers 62 because the limit switch 63 will not sense the presence of a stud at the fastening station 18.

Automatic actuation of some of the mechanisms of the assembly device can be controlled in a conventional manner through a controller 126 (FIG. 4) responsive to the position of the carriage 40 or to other limit switches responsive to the positions of studs. For example the projector 38 can be set for incremental advancement at the foremost position of the carriage as sensed by the limit switch 74, as can automatic actuation of the stud glue applicator 26 and drill 32. The sheathing dispenser 29, and sheathing nailers 30 can be responsive to multiple advancements of the carriage, such as every third advancement. On the other hand plate glue applicators 24 should operate only while the frame is moving, and should therefore be deactivated when the limit switch 74 senses that the carriage is at either end of its stroke through the same controller 126. An override switch 128 is provided to interrupt, through the controller 126, the aforementioned automatic functions when desired, for example when the extension member 110 is being manipulated to vary stud spacing. Alternatively the positioning and timing of some or all of the functions of the glue applicators, sheathing dispenser, drill, and sheathing nailers, as well as that of the saw 34 can be controlled by workmen situated along the assembly line in an efficient manner. The saw 34 may be located sufficiently far away from the fastening station 18 that the fastening of the entire frame is complete before any portion thereof reaches the saw, so that movement of the frame under the saw can be controlled manually rather than by movement of the carriage 40, or by other mechanical means if desired.

The terms and expressions which have been employed in the foregoing abstract and specification are used therein as terms of description and not of limitation, and there is no intention, in the use of such terms and expressions, of excluding equivalents of the features shown and described or portions thereof, it being recognied that the scope of the invention is defined and limited only by the claims which follow.

What is claimed is:

1. An apparatus for constructing a building wall, said wall having a frame comprising a pair of elongate parallel plate members and a plurality of parallel elongate studs disposed at predetermined regularly spaced intervals transversely between said plate members, said apparatus comprising:

a. elongate support means for supporting said plate members in horizontally disposed positions spaced from and parallel to one another and extending along the length of said support means;

b. fastening means located at a predetermined fastening station along the longitudinal sides of said support means for fastening studs to said plate members;

c. stud-placement means disposed in predetermined relation to said support means for placing studs one-at-a-time upon said support means at said fastening station such that said studs extend transversely between said plate members for fastening thereto by said fastening means; and d. drive means attached to said support means for reciprocating forwardly and rearwardly along the length of said support means and engaging a stud after it has been fastened to said plate members so as to push against said stud and thereby move said stud and plate members longitudinally of said support means through a distance corresponding to one of said predetermined regular stud intervals.

2. The apparatus of claim 1 wherein said drive means comprises a movable carriage reciprocally powered forwardly and rearwardly longitudinally of said support means by a motor, said carriage having a vertically-oriented movable finger and means for extending said finger to push against the side of a stud on forward movement of said carriage and for retracting said finger to pass an adjacent rearward stud on rearward movement of said carriage.

3. The apparatus of claim 2 further including means for selectively holding said movable finger constantly in said retracted position regardless of the movement of said carriage.

4. The apparatus of claim 2 wherein said stud placement means includes means for removing each said stud to be placed between said plate members from a stack of said studs and positioning said stud transversely on said support means, and a vertically-oriented finger fixedly attached to said carriage rearwardly of said movable finger for engaging and pushing each said transversely-positioned stud forwardly to said fastening station.

5. The apparatus of claim 1 wherein said drive means comprises a movable carriage reciprocally powered forwardly and rearwardly longitudinally of said support means by a motor, and control means connected to said carriage and said motor respectively for reversing the direction of movement of said carriage produced by said motor automatically in response to said carriage reaching predetermined locations relative to said support means on forward and rearward movements respectively of said carriage.

6. The apparatus of claim 5 wherein said control means include adjustable means for varying at least one of said predetermined locations.

7. The apparatus of claim 1 further comprising means attached to said drive means for selectively grasping a stud which has already been fastened to said plates so as to move said stud and plate members selectively forwardly or rearwardly on said support means in response to the direction of movement of said drive means.

8. An apparatus for constructing a building wall having a frame comprising a pair of elongate parallel plate members and a plurality of parallel elongate studs disposed at spaced intervals transversely between said plate members, said apparatus comprising:

a. elongate support means for supporting said plate members in horizontally-disposed positions spaced from and parallel to one another and extending along the length of said support means;

b. fastening means located at a predetermined fastening station along the longitudinal sides of said support means for fastening studs to said plate members individually;

c. means associated with said support means for moving said fastened studs and plate members away from said fastening station after each stud has been fastened to said plate members;

d. means above said support means for holding a plurality of studs in a stack with said stacked studs disposed transversely to said plate members and arranged in a plurality of adjacent vertical columns; and e. stud selection and placement means for removing studs individually from the bottom of one of said columns of said stack and placing said studs transversely between said plate members on said support means.

9. The apparatus of claim 8 wherein said means for holding a plurality of said studs in a stack includes a surface above said support means for supporting said stack of studs, said surface being sloped downward relative to the longitudinal direction of said support means, said stud selector means including a movable push member adjacent said stack-supporting surface having an upwardly protruding dog for engaging each said stud to be removed from said stack.

10. The apparatus of claim 9 further including adjustable means for varying the motion of said push member to engage different widths of studs.

* * * * *